United States Patent [19]

Ball et al.

[11] Patent Number: 4,696,066

[45] Date of Patent: Sep. 29, 1987

[54] HEATED COAT LINER

[76] Inventors: Joyce A. Ball; Glen W. McKettrick, both of 7031 Mills Ave., Jacksonville, Fla. 32211

[21] Appl. No.: 907,235

[22] Filed: Sep. 15, 1986

[51] Int. Cl.[4] ..... A41D 27/02

[52] U.S. Cl. ..... 2/272; 2/97; 2/102

[58] Field of Search ..... 2/272, 97, 102, 94; 36/2.6

[56] References Cited

U.S. PATENT DOCUMENTS

| | | | |
|---|---|---|---|
| 1,006,415 | 10/1911 | Stubling | 36/2.6 |
| 1,691,472 | 11/1928 | Graham | 36/2.6 |
| 3,000,616 | 9/1961 | Spangler | 36/2.6 |
| 3,906,185 | 9/1975 | Gross et al. | 36/2.6 |
| 3,946,193 | 3/1976 | Giese | 36/2.6 |
| 3,950,789 | 4/1976 | Konz et al. | 2/DIG. 6 |
| 4,507,877 | 4/1985 | Vaccari et al. | 36/2.6 |
| 4,597,906 | 10/1985 | Nishida | 2/272 |

FOREIGN PATENT DOCUMENTS

| | | | |
|---|---|---|---|
| 148646 | 9/1982 | Japan | 2/102 |

*Primary Examiner*—Harvey C. Hornsby
*Assistant Examiner*—Mary A. Ellis
*Attorney, Agent, or Firm*—Arthur G. Yeager

[57] ABSTRACT

A detachable heatable coat liner including two front panels and a back panel joined together by a waist belt, each panel having a fire retardant layer to which is attached a length of electric resistance wire, a layer of fabric with a coating of "Teflon" positioned such that the coating lies against the resistance wire, and two outside layers of coat fabric enclosing the other two layers, a lead wire connecting all lenths of resistance wire and a plug attachable to a source of power, the liner being attachable to the coat by strips of "Velcro" fastener.

8 Claims, 4 Drawing Figures

HEATED COAT LINER

BACKGROUND OF THE INVENTION

Those who hunt, fish, ski, work or participate in any activities when the weather is cold are frequently in need of extra clothing to keep their bodies warm. In recent times it has become commonplace to wear electrically heated clothes, such as socks, mittens, pants, and coats. These articles, however, have sometimes been uncomfortable to wear, not very durable, and not warm enough for a reasonable length of time.

It is an object of this invention to provide an improved electrically heated coat liner. It is another object of this invention to provide a novel structure for an electrically heated coat liner. Still other objects will become apparent from the more detailed description which follows.

BRIEF SUMMARY OF THE INVENTION

This invention relates to a coat liner comprising a back panel, a left front panel and a right front panel, each said panel adapted to be attached to the inside of a coat, vest, or other garment, each said panel including a layer of fire retardant fabric having a pattern of electric resistance heating wire attached to one surface thereof, a layer of fabric coated on one side with a polyfluorocarbon resin, said resin coating lying against said heating wire, and a layer of coating fabric lying against the uncoated surface of said fabric coated with polyfluorocarbon resin, and an electrically insulated wire connecting said heating wire to a plug attachable to a source of electric power.

In a preferred embodiment the layer carrying the electric resistance wire is Nomex, the coated layer is coated with Teflon, and these two layers are enclosed by an outside layer and an inside layer of selected coat material, with all four layers sewn together. cl BRIEF DESCRIPTION OF THE DRAWINGS The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
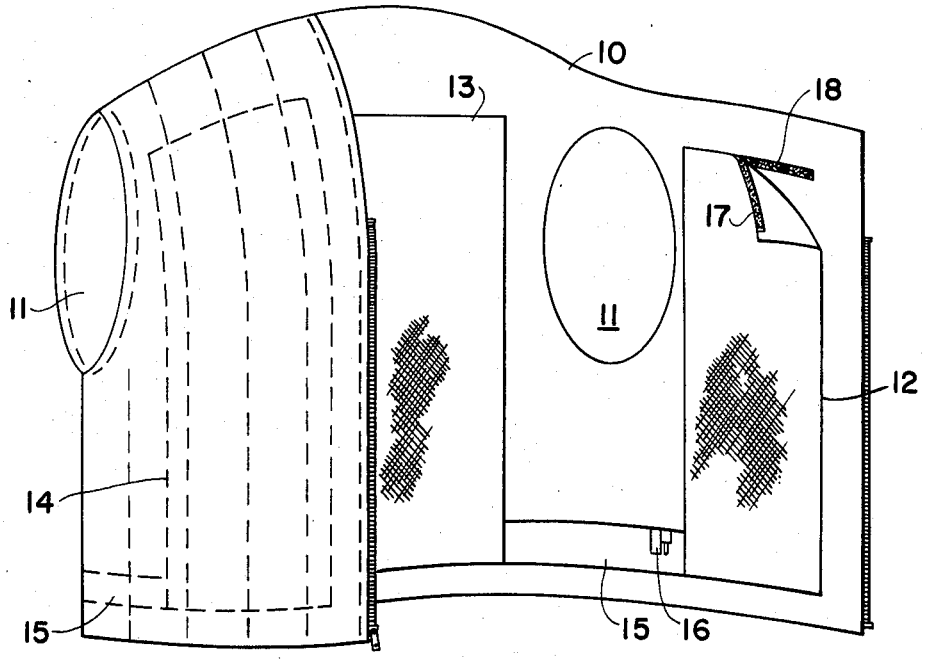
FIG. 1 is a schematic illustration of a vest with the liner of this invention attached thereto.

The overall view of how this invention is used is seen in FIG. 1. A quilted vest 10 filled with loose fiber, fleece, or the like, has two arm holes 11 and may be fastened in front by a zipper, buttons, or the like. On the inside of vest 10 is a liner consisting of three panels 12, 13, and 14 joined to each other by a waist belt 15. Left front panel 12 is shown with an upper corner turned back to show a "Velcro" fastener including a strip 17 of fabric hooks on panel 12 and a strip 18 of fabric loops on vest 10. A similar pair of strips are preferably at the bottom of panel 12 to provide a secure attachment between vest 10 and liner panel 12. Each of the other panels, namely, right front panel 14 and back panel 13 are attached to vest 10 by similarly located strips of "Velcro" fastener. It is not critical that this type of fastener be used since snaps, zippers, or the like may be employed to fasten panels 12, 13, or 14 to the inside of vest 10. "Velcro" fasteners are preferred because of convenience and light weight. The cooperating loops and hooks of the "Velcro" fastener may be attached to the panel or to the vest although it is preferred to have the fabric loops on the vest because it would be less troublesome when wearing the vest without the liner attached. An electric wire is encased in belt 15 of the liner to connect electric resistance heating wire in each of panels 12, 13, and 14 to a plug 16 which can be attached to any convenient source of 12 volt D.C. electric power, e.g., two 6-volt battery packs in series.

Figure 2:
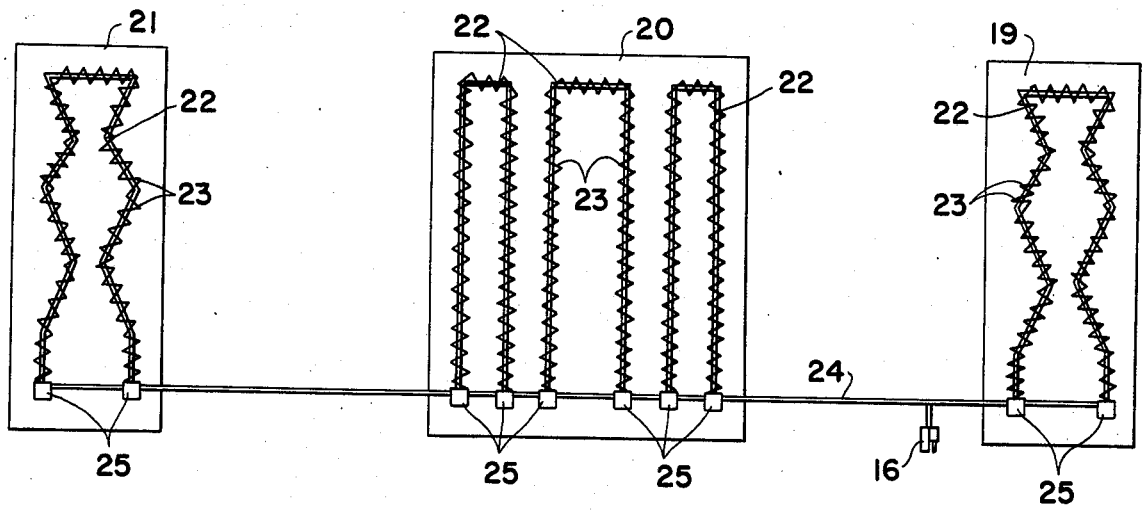
FIG. 2 is a plan view of an internal fabric layer to which the electric resistance wire is attached.
Figure 3:
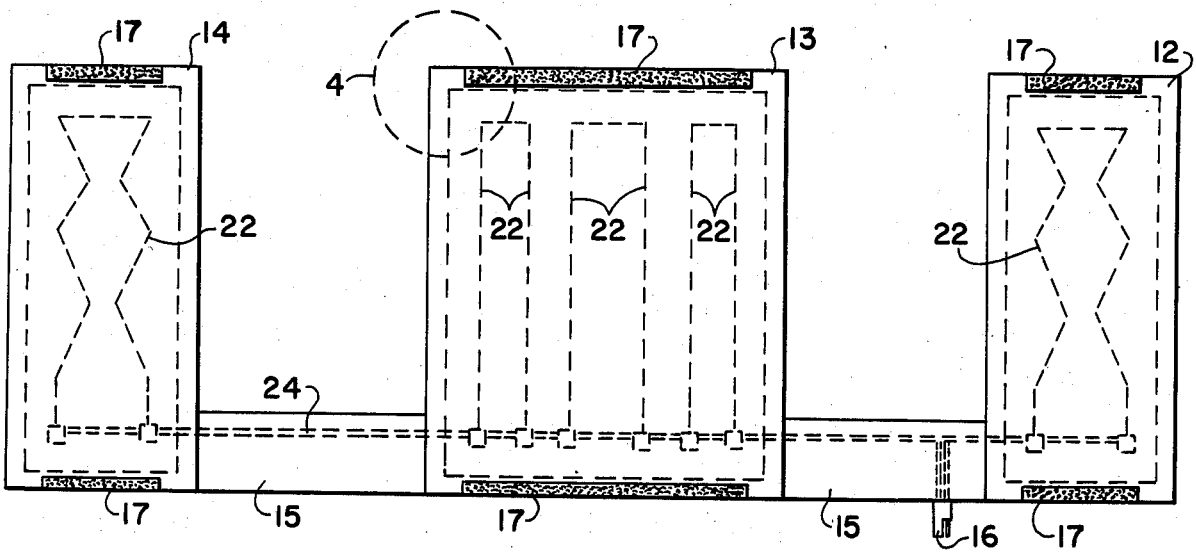
FIG. 3 is a plan view of the liner of this invention.
Figure 4:
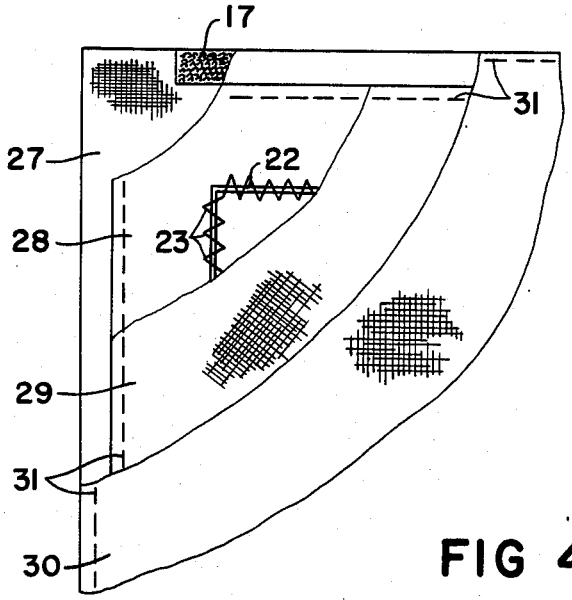
FIG. 4 is an enlarged broken away view of the portion marked 4 in FIG. 3.

The interior structure of the liner is best illustrated in FIGS. 2–4. There are at least three, and preferably four, layers of fabric in the liner. Two outside layers are of any desired coat material, e.g., wool, cotton, nylon, polyester, and mixtures thereof in whatever type of woven structure that is desired. For use by hunters or fishermen, it is frequently desirable for the outer layers to be a polyester/cotton mixture treated to be water repellant. The two inner layers are employed to hold the heating elements in place and to protect against any overheating of the outer layers by distributing the heat throughout the liner. In FIG. 4 there is shown a typical structure of a liner. Two outer layers 27 and 30 enclose two inner layers 28 and 29. Stitching 31 is preferably used to hold all layers together, although in some instances adhesives may be employed. Layer 28 is a fire retardant material, preferably a nonwoven, felted material. The best known fabric for this purpose is "Nomex" made by E.I. duPont de Nemours & Co. Layer 28 carries the heating element, preferably nickel-copper resistance wire 22 which is sewn to layer 28 by suitable heat resistant thread 23. Layer 29 faces and covers wire 22, and, therefore, must be fire retardant also. The preferred material for layer 29 is a woven fabric of nylon, cotton, or the like, coated with a perfluorocarbon resin, preferably polytetrafluoroethylene. The side coated with the perfluorocarbon resin is placed in contact with wire 22. This material is fire retardant and serves admirably to distribute the heat from wire 22 in all directions. A suitable material for layer 29 is that used as an ironing board cover.

In FIG. 2 there is a schematic layout of layer 28. There are three panels including back panel 20, left front panel 19 and right front panel 21. Each panel has one or more patterns of electric resistance wire 22 attached thereto by stitching 23. Preferably wire 22 is nickel-copper resistance wire. In panel 20 there are shown three rectangular loops of wire 22. In panels 19 and 21 there is shown a single loop in a zigzag pattern. It is important to match the length of wire in the loops with the heat output of wire 22. For example, in a medium to large size vest, there may be 33–35 inches of nickel-copper wire 22 in each of panels 19 and 21, and 31–35 inches of wire in each of three loops in panel 20. The zigzag pattern of the loops in panels 19 and 21 are employed merely to lengthen the amount of wire in each loop and thereby distribute the heat more evenly. An insulated electric lead wire 24 connects each of the loops of wire 22 to a plug 16. Lead wire 24 is preferably a length of 18–2 copper wire insulated with a rubber or plastic covering. Each of the loops of resistance wire 22 is connected in parallel across the two wires in lead wire 24. This type of circuitry provides the advantage that if any single loop of resistance wire is damaged or otherwise is incapable of providing heat, the remaining loops will be fully operable. Each connection between wire 22 and wire 24 has been insulated with rubber foam tape 25. Plug 16 is suitable for connection to whatever type of 12 volt D.C. power source that is available, normally some type of D.C. battery pack or the like. It is preferred to employ a 12- volt 12-amp battery pack, which may be a combination of two 6-volt batteries in series. Such a battery pack will provide adequate heating for about two and one-half hours.

The finished liner is shown in FIG. 3 where all four layers 27, 28, 29, and 30 have been joined together encasing heating wire loops 22. A belt 15 of the same material as that of outer layers 27 and 30 encases lead wire 24 and connects the three panels 19, 20, and 21 to each other. Plug 16 is available for connection to a 12 volt D.C. power source directly or through an extension cord (not shown). The liner is attached to the inside of any suitable vest, coat, sweater, or the like. The method of attachment may be anything that is suitable anc convenient, whether permanent or detachable. Shown here are "Velcro" fabric fasteners for a detachable attachment. Strips 17 are attached to the liner and cooperating strips are attached to the vest, coat, or sweater. Preferably, strips 17 are fabric hooks and the strips attached to the vest, coat, or sweater are fabric loops. This arrangement makes the vest, coat, or sweater suitable for use when the liner is not attached thereto. Other types of fasteners are operable in place of "Velcro", e.g., snaps, ties, zippers, etc.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A coat liner comprising a back panel, a left front panel and a right front panel, each said panel adapted to be attached to the inside of a coat, each said panel including a layer of fire retardant fabric having two surfaces and a pattern of electric resistance heating wire attached to one said surface thereof, a layer of fabric having two sides and coated on one side with a polyfluorocarbon resin, said resin coating lying against said heating wire, and a layer of coating fabric lying against the other of said sides of said fabric, and an electrically insulated wire connecting said heating wire to a plug attachable to a source of electric power.

2. The coat liner of claim 1 which additionally comprises a second layer of coating fabric lying against the other of said surfaces of said layer of fire retardant fabric.

3. The coat liner of claim 1 wherein said polyfluorocarbon resin is polytetrafluoroethylene.

4. The coat liner of claim 1 wherein said fire retardant fabric is Nomex.

5. The coat liner of claim 1 which additionally comprises strips of fabric hook fastener and said garment includes corresponding strips of fabric loop fastener.

6. A vest liner attachable to the inside of a vest to enhance the warmth of the vest, the liner comprising a right front panel, a left front panel, and a back panel attached to each other by a waist belt, each said panel detachably attachable to the inside of said vest by cooperating strips of fabric hooks on said liner and fabric loops on said vest; said panels each comprising two outer layers of coating fabric and two inner layers stitched together to form a four-layered panel; one of said inner layers being a fire retardant fabric with at least one length of an electric resistant nickel-copper wire attached thereto in a pattern substantially equally distributed over the surface of said fire retardent panel, and the other of said inner layers being a fabric coated on one side with polytetrafluoroethylene, said polytetrafluoroethylene coating being in contact with said nickel-copper wire, and an insulated lead wire attached to each said length of nickel-copper wire and having a plug available outside said liner which is attachable to a source of electric power.

7. The liner of claim 6 wherein said first retardant fabric is Nomex.

8. The liner of claim 6 wherein said source of power is of a 12-volt D.C. electric output.

* * * * *